US009169043B2

(12) United States Patent
Witkowski et al.

(10) Patent No.: US 9,169,043 B2
(45) Date of Patent: Oct. 27, 2015

(54) CONTAINER WITH REMOVABLE TRAY

(75) Inventors: Slawek Witkowski, Florence, SC (US); R. Michael Schock, Hartsville, SC (US); Laura Boatwright, Hartsville, SC (US); Michael L. Thornton, Fort Mill, SC (US)

(73) Assignee: SONOCO DEVELOPMENT INCORPORATED, Hartsville, SC (US)

( * ) Notice: Subject to any disclaimer, the term of this patent is extended or adjusted under 35 U.S.C. 154(b) by 0 days.

(21) Appl. No.: 13/584,438

(22) Filed: Aug. 13, 2012

(65) Prior Publication Data

US 2014/0042158 A1 Feb. 13, 2014

(51) Int. Cl.

| | |
|---|---|
| ***B65D 21/02*** | (2006.01) |
| ***B65D 25/00*** | (2006.01) |
| ***B65D 81/32*** | (2006.01) |
| ***B65D 43/02*** | (2006.01) |

(52) U.S. Cl.

CPC ..... *B65D 25/00* (2013.01); *B65D 43/0212* (2013.01); *B65D 81/3216* (2013.01); *B65D 2543/00092* (2013.01); *B65D 2543/00277* (2013.01); *B65D 2543/00296* (2013.01); *B65D 2543/00537* (2013.01)

(58) Field of Classification Search

CPC .... B65D 25/04; B65D 21/02; B65D 43/0212; B65D 2543/00537; B65D 81/3216; A47G 19/26

USPC ..... 220/23.83, 23.86, 23.89, 23.87; 206/514

See application file for complete search history.

(56) References Cited

U.S. PATENT DOCUMENTS

| | | | | |
|---|---|---|---|---|
| 2,904,205 | A * | 9/1959 | Callery | 215/391 |
| 3,777,882 | A * | 12/1973 | McIntyre | 206/370 |
| 4,466,553 | A * | 8/1984 | Zenger | 220/495.08 |
| 4,491,219 | A * | 1/1985 | Lutz | 206/216 |
| 4,714,158 | A * | 12/1987 | Oltman et al. | 206/349 |
| 5,117,979 | A * | 6/1992 | Brightbill | 206/372 |
| 5,222,534 | A * | 6/1993 | Wilkinson, Jr. | 141/88 |
| 5,547,098 | A * | 8/1996 | Jordan | 220/23.86 |
| 5,634,569 | A * | 6/1997 | DeCoster | 220/735 |
| 5,653,271 | A * | 8/1997 | Brittain et al. | 141/98 |
| 2004/0058038 | A1 | 3/2004 | Lee | |
| 2005/0051549 | A1 | 3/2005 | Nelson | |
| 2007/0000922 | A1 | 1/2007 | Vovan et al. | |

FOREIGN PATENT DOCUMENTS

FR 1280021 12/1961

OTHER PUBLICATIONS

International Preliminary Report on Patentability dated Feb. 26, 2015 issued in PCT Application No. PCT/US2013/051254, filed Jul. 19, 2013.

PCT International Search Report for related PCT Patent Application No. PCT/US2013/051254.

PCT Written Opinion of the International Searching Authority for related PCT Patent Application No. PCT/US2013/051254.

PCT Partial International Search for related PCT Patent Application No. PCT/US2013/051254.

* cited by examiner

*Primary Examiner* — Stephen Castellano

(74) *Attorney, Agent, or Firm* — Nelson Mullins Riley & Scarborough LLP

(57) ABSTRACT

The present invention relates to a container including a container body with a removable tray wherein the container can house at least two materials that must be kept separate until use. The container also may have upwardly extending fingers in the removable tray for securing a material.

12 Claims, 5 Drawing Sheets

FIG. –1–

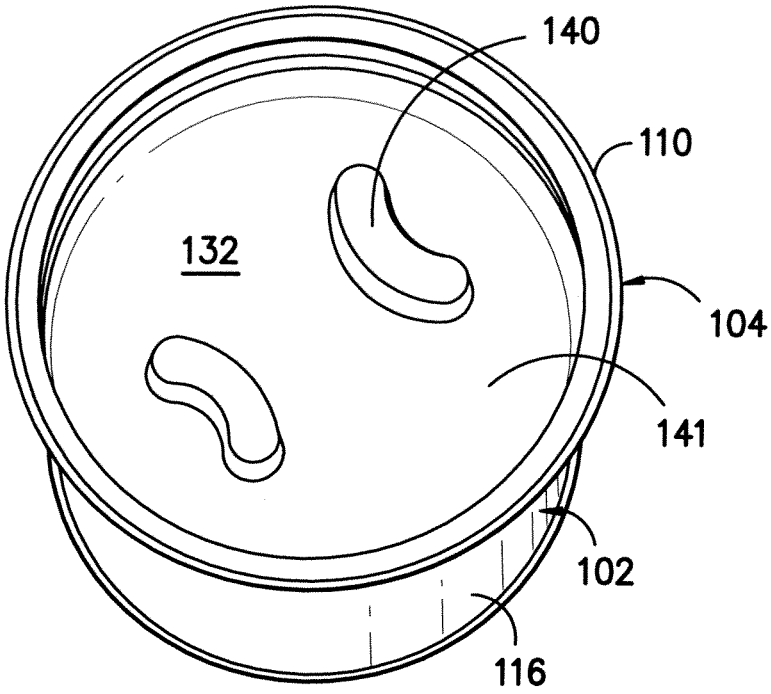
FIG. –5–
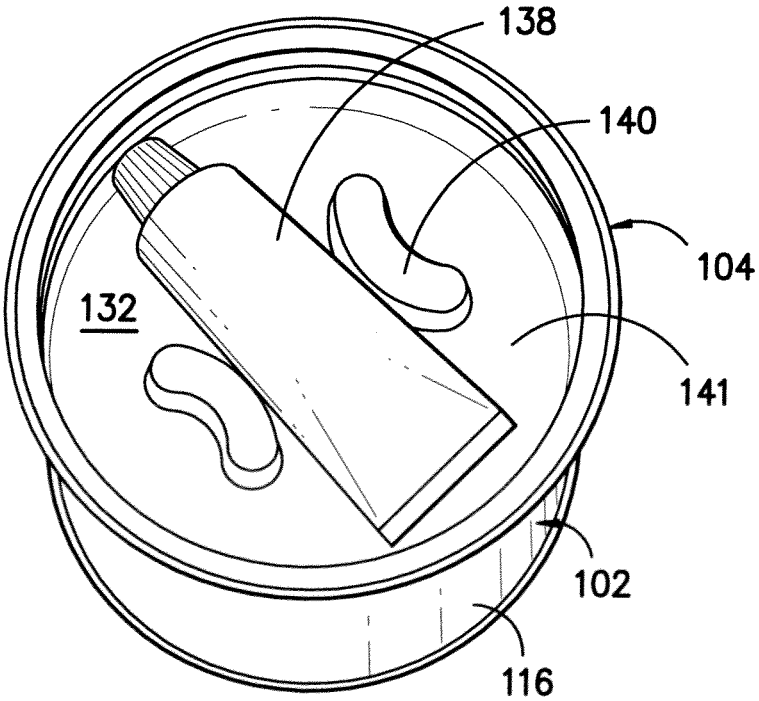
FIG. –6–

CONTAINER WITH REMOVABLE TRAY

FIELD OF THE INVENTION

The present invention relates generally to containers for the storage of various materials. More particularly, the present invention relates to a container with a removable tray for the storage of multiple materials types of within the same container.

BACKGROUND OF THE INVENTION

Storage containers of varying sizes and materials have been, and continue to be, utilized in a number of applications. Storage containers generally include a container body for holding the desired contents and a lid for covering the container body and enclosing the contents within an interior of the container. However, efforts have been made to adapt containers to many particular applications.

SUMMARY OF THE INVENTION

According to an aspect, the present invention provides a container including: a container body defining a first body end, a second body end, an internal surface and an external surface; a removable tray within the container body; a membrane enclosing the first body end and the removable tray; and a pair of upwardly extending fingers on a bottom portion of the removable tray that do not extend beyond the membrane.

According to another aspect, the present invention also provides a container including: a container body defining a first body end, a second body end, an internal surface and an external surface; a removable tray within the container body; a membrane enclosing the first body end and the removable tray; and a ridge located on at least a portion of an external surface of the removable tray that mates with a corresponding structure of the internal surface of the container and is below the membrane.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which:

FIG. 5 is an overhead, perspective view of the container of FIG. 1, where the overcap and membrane have been removed; and FIG. 6 is an overhead, perspective view of the container of FIG. 5, where a housing of a second material has been included.

Figure 1:
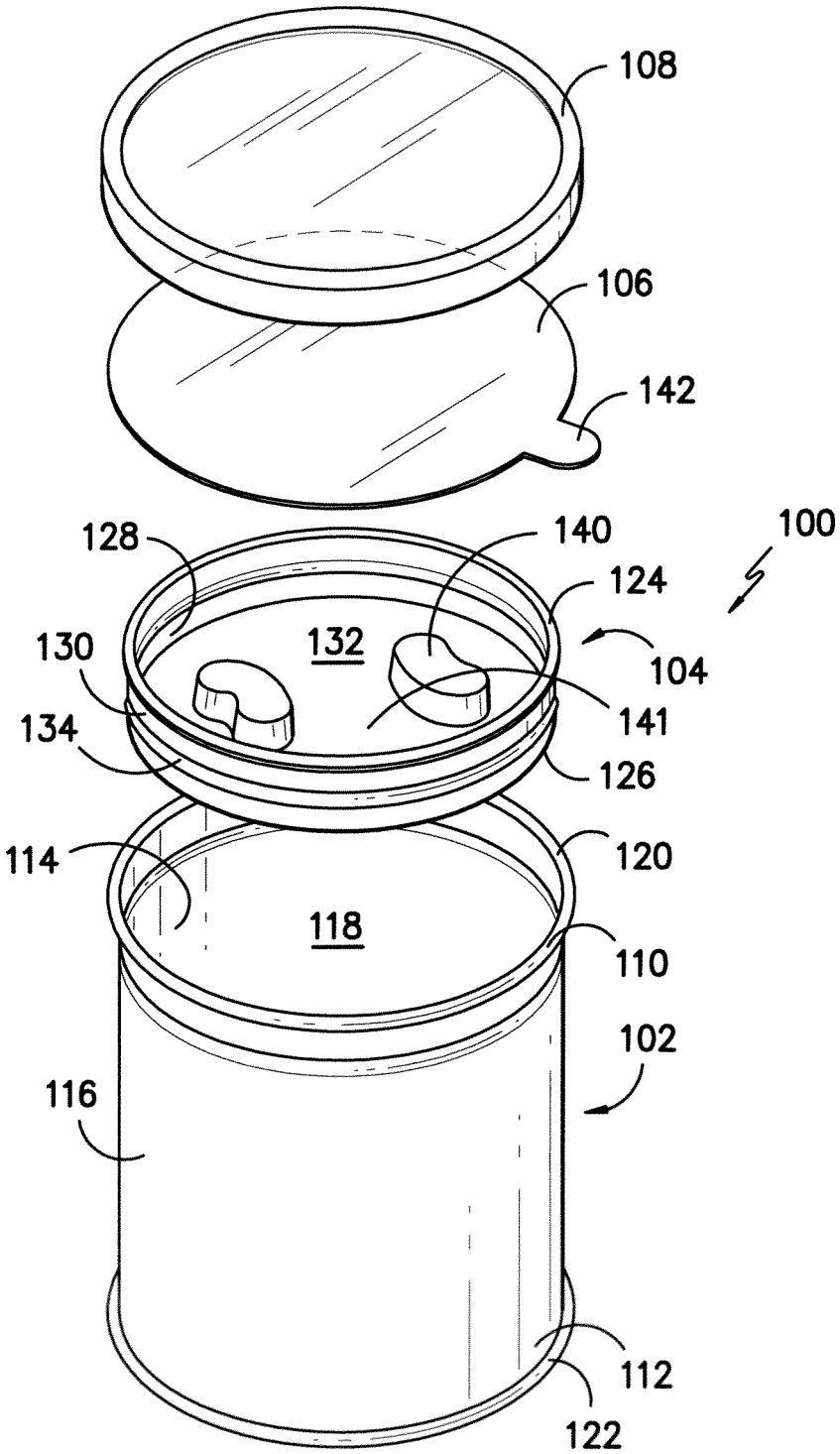
FIG. 1 is an exploded perspective view of a container in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

A container in accordance with an embodiment of the present invention is shown in the Figures. As shown in FIG. 1, container 100 includes a container body 102, a removable tray 104, a membrane 106 enclosing removable tray 104, and an overcap 108. As more fully discussed below, container 100 allows for the separation of two or more materials, where a first material may be placed within container body 102 and a second material may be placed in removable tray 104. Such embodiments of the present invention may be appropriate when there is a need to maintain separation between the first and second materials until desired by the user. For example, container 100 may be used to house automotive body putty or other styrene-based products that require both the putty itself (first material) and a hardening agent (second material) to remain separated and not in contact until used. Such separation of the first and second material may be of extreme importance, as the mixing of the two materials prior to the desired time could ruin the product itself.

As indicated above, container 100 includes container body 102. Although container body 102 is illustrated in the figures in a cylindrical shape, container body 102 may be constructed of any shape based on the specifications of the user. For example, in some embodiments, container body 102 may be oblong, oval, square, triangular, rectangular, trapezoidal, an irregular shape, or others known or contemplated in the art. Container body 102 includes a first body end 110, an opposite second body end 112, an internal surface 114 and an opposite and outer external surface 116. The various components of container body 102 define a container space 118 that is located between first body end 110 and second body end 112 and is confined by container body internal surface 114. Container space 118 allows for the containment of the first material that may maintain separation from the second material or item that is located within removable tray 104.

Figure 2:
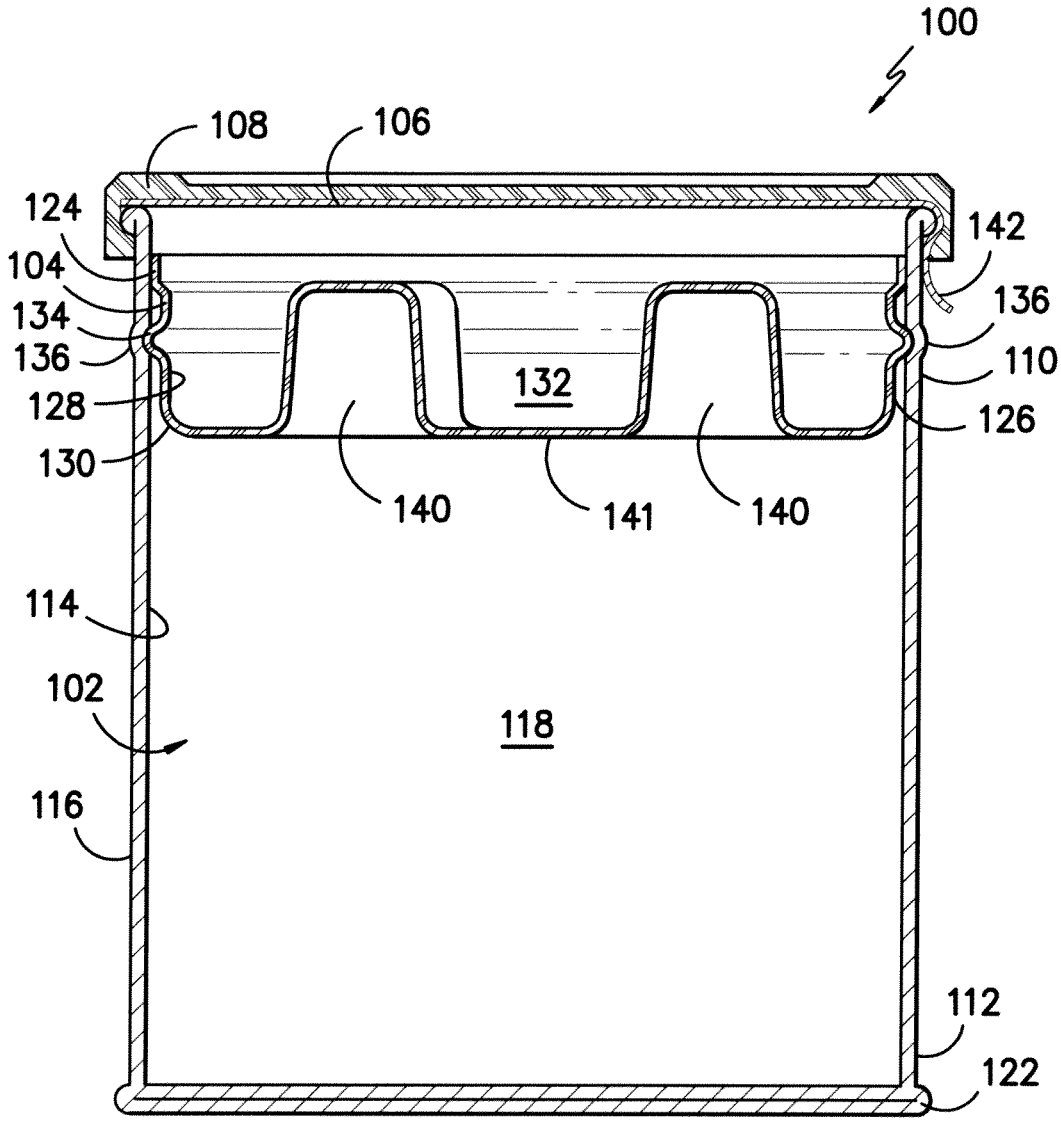
FIG. 2 is a side, cross-sectional view of the container of FIG. 1.

As illustrated in FIGS. 1 and 2, container body external surface 116 is an outer portion of container 100 and may serve to include a label or some other type of identifying features. For example, in some embodiments, container body external surface 116 may include a label of trademarks, list of components within the container, or other identifying indicia. Container body external surface 116 may also be utilized to protect the contents of container body 102 and, accordingly, may be constructed of any material known in the art that may be used in connection with containers. For example, in some embodiments, container body external surface 116 may be constructed of plastics, metals, papers, as well as other materials known or contemplated in the art, and combinations thereof.

Container body first body end 110 includes an open portion into which removable tray 104 and a first material may be placed so as to be contained within container space 118. In some embodiments, and as shown in FIG. 1, container body first body end 110 may include a first end lip 120 that extends along the perimeter of container body 102. First end lip 120 may aid in the securing of overcap 108 to container 100 such that a desired amount of force is required to remove overcap 108. Container body second body end 112 includes an enclosed surface (not shown) and typically remains oriented as a bottom portion of container body 102. Second body end 112 may be constructed of a suitable material to maintain the weight of the contents of container 100, namely first and second materials. In addition, in some embodiments, second body end 112 may also include a second end lip 122 that may aid in maintaining the shape of container 100 or may provide additional strength to container 100.

As shown in FIG. 2, removable tray 104 of the present invention may be placed within container space 118 and may house a second material that may remain separate from the first material until desired by the user. Although removable tray 104 is illustrated as proximate container body first body end 110, removable tray 104 may be placed at any position within container space 118 that still provides adequate volume for the first material to be housed beneath removable tray 104 within container space 118. Removable tray 104 includes a first end 124, an opposite second end 126, an internal surface 128 and an opposite external surface 130. Like container body 102, the components of removable tray 104 define a removable tray space 132 between first end 124 and second end 126 that is confined within internal surface 128.

In some embodiments and as shown in FIG. 2, at least a portion of removable tray external surface 130 may make contact with corresponding structure on container body internal surface 114. This may be accomplished by having, as shown in the figures, removable tray 104 and container body 102 constructed in the same shape. However, in additional embodiments, contact between removable tray external surface 130 and container body internal surface 114 may be accomplished with removable tray 104 and container body 102 constructed in different shapes. For example, in some embodiments, container body 102 may be cylindrical in shape while removable tray 104 may be constructed as a lid-less rectangular box. The user's specifications may dictate the particular shapes utilized.

In embodiments where contact is made between removable tray external surface 130 and container body internal surface 114, removable tray external surface 130 may further include an outer ridge 134 that extends along at least a portion of external surface 130. Outer ridge 134 may be an abutment that extends from removable tray external surface 130 and may aid in maintaining the desired placement of removable tray within container space 118 as it applies an additional level of stress to corresponding structure found on container body internal surface 114. Outer ridge 134 may be constructed in any shape as required by the user including a circle, square, v-shape, or portions thereof. In embodiments of the present invention that utilize an outer ridge 134, container body internal surface 114 may further include a mating groove 136, or other structure corresponding to outer ridge 134, that outer ridge 134 may fit within when removable tray 104 is placed in container space 118. The placement of mating groove 136 within container body 102 may be decided by the user and may provide an additional level of security in maintaining the placement of removable tray 104 within container space 118.

As indicated above, removable tray 104 may be utilized to house a second material or item within container space 118. Accordingly, removable tray first end 124 includes an open portion such that a user may access removable tray space 132. In addition, second end 126 may include an enclosed surface such that the first material may be prevented from interacting with second material until desired by the user.

Any material or item may be utilized as the second material to be placed within removable tray 104. In some embodiments, the second material may be included in a housing 138, such as a tube, and may be removed when desired by the user. In such embodiments, and as shown in FIGS. 2 and 5 through 6, removable tray second end 126 may further include at least two upwardly extending fingers 140 that extend upwardly within removable tray space 132 from a bottom portion 141 of removable tray 104. In embodiments that utilize such upwardly extending fingers 140, fingers 140 may extend at any distance within removable tray space 132 and may extend beyond such space 132 above removable tray first end 124. Such extension of upwardly extending fingers 140 may be of any length provided that it does not hinder the placement of membrane 106 on container body first body end 110.

Upwardly extending fingers 140 may be of any shape in accordance with the user s specifications and each particular finger may be the same shape or a different shape than the other upwardly extending fingers 140. In some embodiments, upwardly extending fingers 140 may be square, rectangular, circular or any other polygonal shape or portion thereof. In further embodiments, and as shown in FIGS. 1 through 2 and 5 through 6, upwardly extending fingers 140 may be in converse half-moon shapes. Such shape of upwardly extending fingers, as well as others, may aid in providing a snap-fit of housing 138 for the second material within removable tray space 132. Such securing of housing 138 may allow a user to avoid the movement of housing 138 within removable tray space when container 100 is moved to various locations, for example during shipping or through the consumer purchase process.

In addition, although removable tray 104 is illustrated with t o upwardly extending fingers 140, in additional embodiments, any number of fingers 140 may be utilized. For example, in some embodiments, three, four, five, six, or more fingers 140 may be used. In such embodiments, fingers 140 may be arranged such that they may accommodate a single housing 138 or they may be used to provide a snap-fit to multiple housings 138. The user's specification may dictate the number of fingers 140 utilized.

It should be noted that although the Figures are illustrated with a single removable tray, in additional embodiments of the present invention, container 100 may include any number of removable trays. For example, in some embodiments, container 100 may include two, three, or more removable trays, where the trays are stacked on one another and are all located within container space 118. The use of more than one removable tray 114 may allow for the separation of any number of materials.

As further indicated above, container 100 includes a membrane 106 which encloses removable tray 104. Such membrane 106 may be of any suitable material, including foil, plastics, metals, paper or others. In some embodiments, membrane 106 may be adhered to container body first body end 110 by the application of adhesive on first body end 110. In embodiments of the present invention where a first end lip 120 is utilized, adhesive may be applied to first end lip 120 prior to the application of membrane 106. In order to aid in the removal of membrane 106, it may further include a pull tab 142. Utilizing embodiments where membrane 106 is adhered to first body end 110, an additional level of tamper resistance is provided, as one may determine whether the membrane 106 has been removed prior to use.

Fitting over membrane 106, is an overcap 108 that supplies an additional level of security to maintain the contents of container 100 within container body 102. Such overcap 108 may provide additional security during shipping or transport from a retail store. As indicated above, in embodiments where a first end lip 120 is used, overcap 108 may fit securely over first end lip 120 such that a desired amount of force is required for removing overcap 108. Overcap 108 may be constructed of any material known in the art, including various forms of plastic, metals or other materials.

Figure 3:
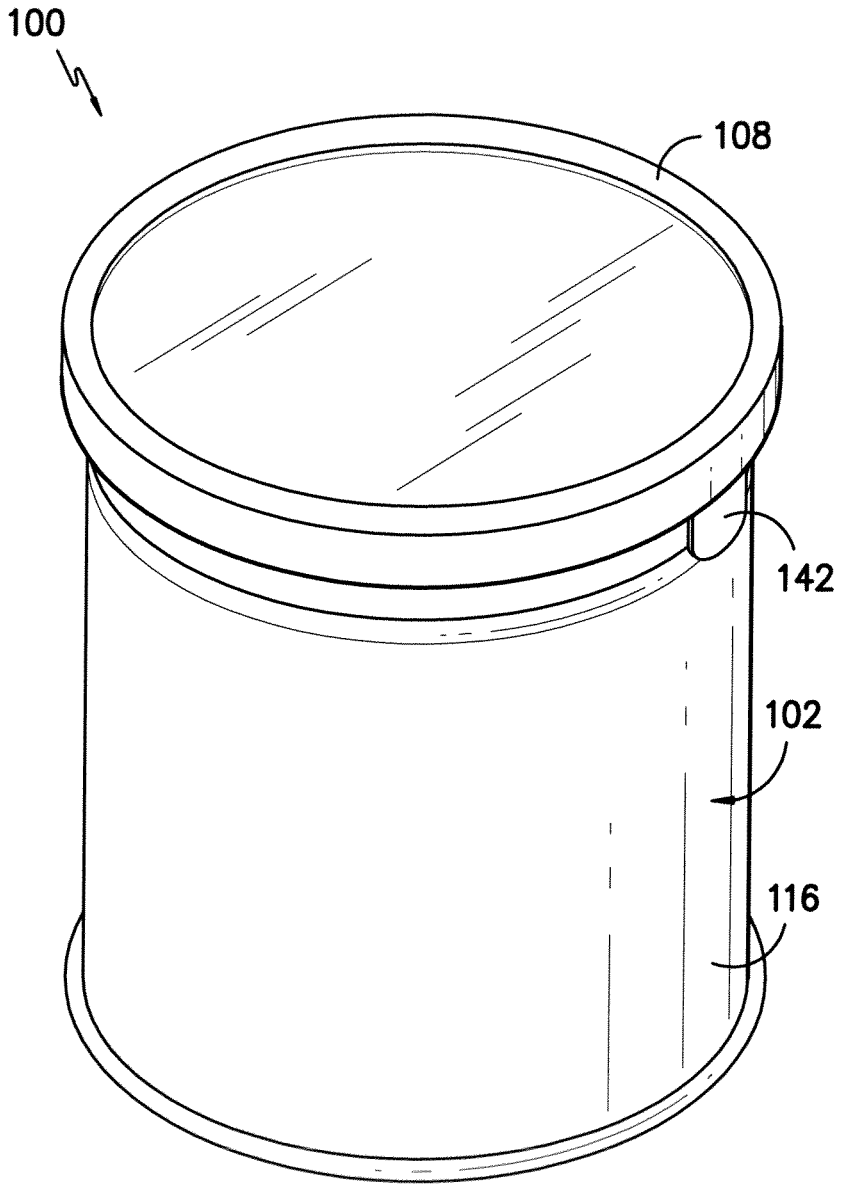
FIG. 3 is a perspective view of the container of FIG. 1.
Figure 4:
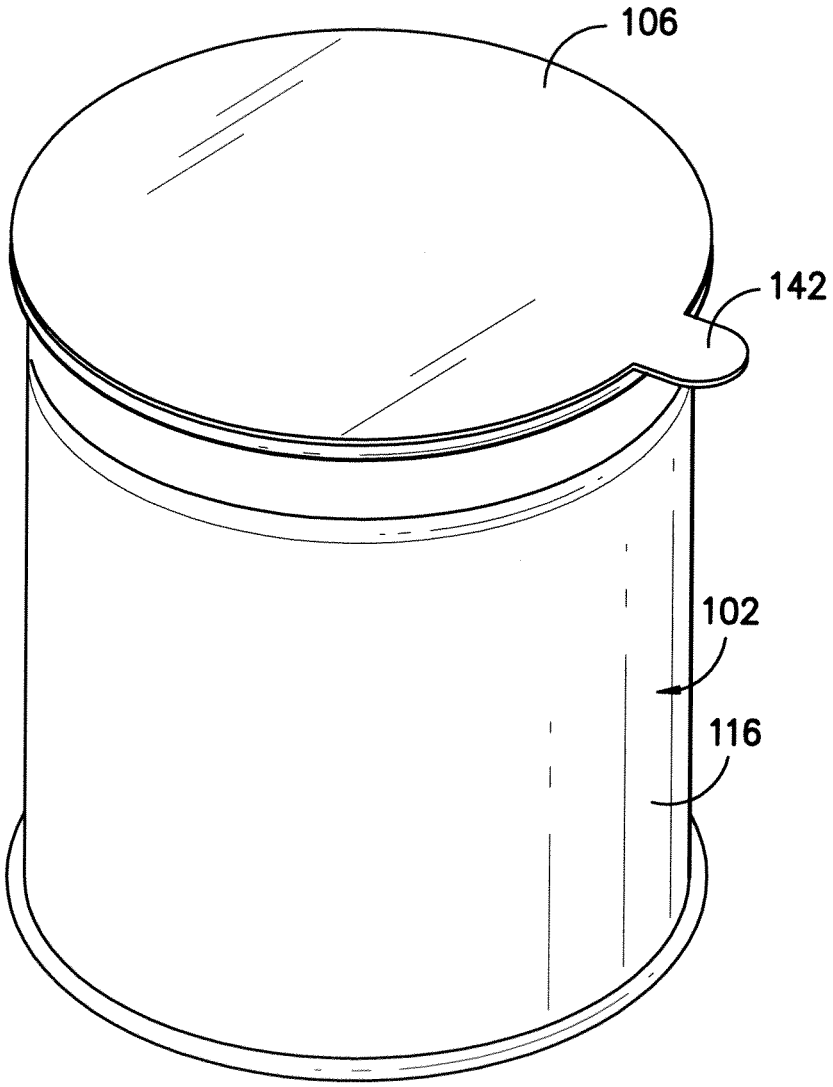
FIG. 4 is a perspective view of the container of FIG. 1, where the overcap has been removed.

In operation, container 100 may be constructed as shown in the Figures. Accordingly, a first material may be placed within container space 118 and then removable tray 104 may be inserted over the first material. As indicated above, in embodiments where an outer ridge 134 is utilized on removable tray external surface 130, the force of outer ridge 134 against container body internal surface 114 may aid in maintaining the placement and position of removable tray 104 within container space 118. In embodiments of the present invention that utilize a mating groove 136 on container body internal surface 114, removable tray 104 may be set within container space 118 until outer ridge 134 of removable tray external surface 130 is secured within mating groove 136. Accordingly, additional levels of securing the placement of removable tray 104 within contain space 118 may be achieved. Membrane 106 is then placed over removable tray 104 (FIG. 4), enclosing the contents and securing them within container space 118. Overcap 108 is then placed over membrane 106 (FIG. 3) and, in some embodiments, secured by the first end lip 120.

When a user is set to utilize the contents of container 100, they may remove overcap 108 by applying upward pressure and pulling it away from container 100. In addition, membrane 106 may be removed from container 100 by applying an upward force to pull tab 142 and pulling membrane 106 away from the removable tray 104. Once membrane 106 has been pulled away or removed to expose the contents of removable tray 104, the user may remove the second material from the upwardly extending fingers 140 and may then remove the entire removable tray 104 from container space 118 to allow access to the first material. Once the first material is accessible, a user may then begin mixing the first and second materials or may utilize them separately.

As indicated above, one configuration of the present invention allows for the second material housed in removable tray to be securely positioned within container to ensure it does not move or become dislodged during shipping or handling. In addition, the use of removable tray ensures that the second material does not easily come in contact with the first material found within the container space. Such configuration may be necessary to ensure that the two materials do not mix prior to use, which could ruin the product itself. In addition, the use of the removable tray external surface with an outer ridge to situate removable tray, allows for removable tray to efficiently and effectively maintain its placement while still allowing for easy removal.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged in whole or in part. Furthermore, those of ordinary skill in the art will appreciate that the foregoing description is by way of example only, and is not intended to limit the invention so further described in such appended claims. Therefore, the spirit and scope of the appended claims should not be limited to the description of the versions contained therein.

What is claimed is:

1. A closed container comprising:

a closed container body defining a first body end, a second body end, an internal surface, an external surface, and a closed container space formed between the first body end and the second body end;

a removable tray within the closed container body, the removable tray having an open portion and an enclosed bottom end located between the first container body end and the second container body end so as to divide the closed container space into a first material container space and a second material container space within the formed container space and wherein the first material container space and the second material container space are separated by the removable tray enclosed bottom end to prevent contact between material in the first material container space and material in the second material container space;

a membrane adhered to the first container body end and enclosing the first container body end and the removable tray;

a closure enclosing the membrane; and at least two fingers extending upwardly from a bottom portion of the removable tray toward the closure and that do not extend beyond the closure.

2. The container of claim 1, wherein the closure is an overcap.

3. The container of claim 1, wherein the first container body end further comprises a first end lip that extends a portion of a perimeter of the first body end.

4. The container of claim 1, wherein the removable tray comprises the same shape as the container body.

5. The container of claim 1, wherein the removable tray is a different shape as the container body.

6. The container of claim 1, wherein the membrane further comprises a pull tab.

7. The container of claim 1, wherein the at least two upwardly extending fingers are of the same shape.

8. The container of claim 1, wherein the container further comprises a housing that is securely fit between the at least two upwardly extending fingers.

9. A closed container comprising:

a closed container body defining a first body end, a second body end, an internal surface, an external surface, and a closed container space formed between the first body end and the second body end;

a removable tray within the closed container body, the removable tray having an open portion and an enclosed bottom end located between the first container body end and the second container body end so as to divide the closed container space into a first material container space and a second material container space within the formed container space and wherein the first material container space and the second material container space are separated by the removable tray enclosed bottom end to prevent contact between material in the first material container space and material in the second material space;

a membrane adhered to the first body end and enclosing the first body end and the removable tray;

at least two fingers extending upwardly from a bottom portion of the removable tray toward the membrane and that do not extend beyond the membrane; and a ridge located on at least a portion of an external surface of the removable tray that mates with corresponding structure of internal surface of the container and that is located below the membrane.

10. The container of claim 9, wherein the container further comprises an overcap that encloses the membrane.

11. The container of claim 9, wherein the container further comprises a second removable tray within the container body and positioned underneath the removable tray.

12. The container of claim 11, wherein the container further comprises a third removable tray within the container body and positioned underneath the second removable tray.

* * * * *